US005729241A

United States Patent [19]

Ergen et al.

[11] Patent Number: 5,729,241

[45] Date of Patent: Mar. 17, 1998

[54] DIRECT BROADCAST SATELLITE ANTENNA COVER

[76] Inventors: Charles W. Ergen, 90 Inverness Cir. East, Englewood, Colo. 80155; Bruce A. McKenzie, 6129 Round Lake Rd., Apopka, Fla. 32712

[21] Appl. No.: 744,971

[22] Filed: Nov. 7, 1996

Related U.S. Application Data

[60] Provisional application No. 60/018,471, May 28, 1996.

[51] Int. Cl.[6] ..... H01Q 1/42

[52] U.S. Cl. ..... 343/872; 343/704

[58] Field of Search ..... 343/872, 704; 220/323, 324, 326; H01Q 1/02

[56] References Cited

U.S. PATENT DOCUMENTS

| | | | |
|---|---|---|---|
| 4,804,972 | 2/1989 | Schudel | 343/840 |
| 5,010,350 | 4/1991 | Lepkin et al. | 343/704 |
| 5,451,972 | 9/1995 | Franklin | 343/840 |
| 5,528,253 | 6/1996 | Franklin | 343/872 |

FOREIGN PATENT DOCUMENTS

| | | | |
|---|---|---|---|
| 0109402 | 4/1990 | Japan | H01Q 1/02 |
| 405175715 | 7/1993 | Japan | H01Q 1/02 |

*Primary Examiner*—Donald T. Hajec
*Assistant Examiner*—Daniel St. Cyr
*Attorney, Agent, or Firm*—Pittenger & Smith, P.C.

[57] ABSTRACT

A cover for protecting a direct broadcast satellite antenna having a flange around the outside perimeter of the antenna. The cover is fabricated from a waterproof, flexible sheet material, such as marine grade vinyl. The cover is sized to have a margin extending approximately one-half of the width of the flange beyond the outside edge of the antenna. A "J clip" strip having one edge folded over in a "J" configuration and having a width approximately the same dimension as the flange of the antenna, is positioned along the outer face of the cover with the opposite edge of the strip aligned even with the edge of the cover. The strip is sewn or otherwise attached to the cover material to form the completed cover. A gap of approximately 6" can be provided along one portion of the perimeter of the cover to provide clearance for the supporting structure and ventilation to the inside of the antenna. As the "J" strip is installed on the flange of the antenna, it is continuously worked around the perimeter which causes the "J" strip to be folded back on the cover material with the edge of the strip contacting the surface of the flange and providing a leveraging effect to tighten the cover material and securely retain it across the face of the antenna.

20 Claims, 1 Drawing Sheet

DIRECT BROADCAST SATELLITE ANTENNA COVER

PRIOR APPLICATION

This is a continuation of provisional patent application, Ser. No. 60/018471, filed May 28, 1996, which is pending.

FIELD OF THE INVENTION

This invention is directed to a cover for a direct broadcast satellite antenna. It is more specifically directed to a cover for a small parabolic type antenna which is stretched tightly over the face of the antenna.

BACKGROUND OF THE INVENTION

In the past years, most antennas for satellite reception were large ungainly structures usually having a diameter in the range of 8–12 feet. These were large concave antennas which were mounted on equatorial axes so that the antenna could be pivoted and positioned for specific satellites orbiting the earth.

As is well known, satellites are placed in a synchronous orbit, usually aligned directly over the Equator. The synchronous orbit requires that the satellite be placed 22,300 miles above the Equator. When in this position, the satellite continuously tracks over substantially the same location as the earth rotates on its axis. In this way the footprint of the satellite transmission remains constant over a specific area, such as the entire United States.

The early satellites were of considerably low power, and consequently the transmitted signal from the satellite was greatly diminished when it reached the surface of the earth. Thus, it was necessary for the receiving satellite antenna to be quite large so as to collect and focus as much of the satellite transmitted energy as reasonably possible to obtain satisfactory signals that could be used for processing the video and audio signals which it contained.

Because of the extremely weak signals that are received by these antennas, small variations in the surface of the antenna or misalignment of the equipment associated with the antenna could greatly reduce the quality of the signals received and relayed to the connected satellite receiver.

A number of environmental items, such as rain, snow, hail, or accumulation of ice can affect the receiving characteristics of the antenna. In addition to the environmental factors, other debris, such as leaves, twigs, dirt and clothing, at times can accumulate on the concave reflective surface of the antenna and cause further reduction in the quality of the signals received. These foreign objects laying in contact with the concave surface of the antenna cause the surface to appear to be electromagnetically distorted which, in turn affects the reflectivity of the energy received by the antenna thus, decreasing the amount of energy actually concentrated at the focus of the antenna. This substantially diminishes the magnitude and quality of the signals that are received and transferred by the antenna.

The curvature of the concave portion of the antenna is designed to focus the received electromagnetic energy at an apex or focal area. For the reception of the received radio frequency energy, a feedhorn or "feed", having a receiving probe, is mounted precisely at the location of the focal area of the specific antenna. The feedhorn housing usually includes a low noise amplifier as well as a block down-converter (LNB) for converting the frequency of the received signal to a lower intermediate range so that it can be transmitted over relatively inexpensive coaxial cable to the satellite receiver for further processing.

Some antenna covers have been utilized with respect to satellite receiving antennas in order to shield the antenna from the environment and debris. Usually these covers are merely thin plastic sheets that were draped over the antenna and the feedhorn structure to protect the antenna and its supporting structure. More sophisticated covers have come into being but these are fabricated from substantial and heavier materials. Because of the size of these covers in addition to their weight, they are quite difficult to handle, install, and maintain. Essentially, it has become impractical to provide covers for satellite antennas which are of the larger diameter size.

With the FCC authorization of direct broadcast satellite reception, satellites have been placed in orbit which are permitted to have considerably higher power so that the energy level beamed to the surface of the earth from the synchronous orbit provides a higher energy level per square foot of antenna area. As a result, the smaller, 18 inch and 36 inch concave antennas, are now found to be quite practical. With this practicality, however, comes the ability to mount and position these antennas in a myriad of locations which heretofore have been inaccessible to the larger satellite antennas.

Because of their smaller size, these new antennas are much easier to handle and therefore are much easier to mount. As a result, the so called direct broadcast satellite antennas can be found mounted on top of roofs, on the side of houses or buildings, and on pipes driven into the ground or on tall extended pipes, such as a flagpoles. Thus, because of their size and weight, it is practical to mount these new antennas wherever the proposed location has a clear view of the window available for receiving signals from the respective satellite transponders. In the past, the larger antennas have most always been located on the ground or near the ground where they were accessible to the user. In this way, the antennas could be manually kept clear of snow or ice, as well as any other contaminants or debris. On the other hand, the direct broadcast satellite antennas, because of their ability to be mounted in inaccessible locations, present entirely different problems with respect to weather, environment, or contaminating objects. Even though the satellite signals received are of considerably higher power, this still does not eliminate the necessity to keep the antenna clear so that there is no apparent distortion of the reflective surface and capability of the antenna. In this way, a high level signal can be obtained, providing superior, high quality signal reception that can be better used by the satellite receiving system.

Most of the present day direct broadcast satellite antennas are of the elliptical offset type wherein the support structure for the feedhorn and LNB are mounted on the outside or undersurface at one end of the antenna itself. In this way, there is no structure within the reflective surface of the antenna and the feedhorn is arranged off-center so as to reduce the obstruction of the reflected signals to the antenna surface that occurs when the feedhorn is positioned directly above the middle or central portion of the antenna.

None of the prior art shows any solution or is directed to providing a suitable protective cover for the smaller possibly inaccessible satellite antennas.

INFORMATION DISCLOSURE STATEMENT

The following section is provided in order to comply with the applicants' acknowledged duty to inform the Patent and Trademark Office of any pertinent information of which they are aware. The following information refers to the patents of which the applicants have knowledge with respect to the subject matter of the present invention. Although other patents may exist which deal with the subject matter, they are believed to be less pertinent than the patents which are disclosed herein and therefore, should not effect the examination of this application.

The Schudel patent (U.S. Pat. No. 4,804,972) discloses an enclosed terrestrial antenna system of monocoque construction. The basic antenna comprises two dish-shaped members having substantially identical configurations. Each member has a central concave parabolic area. One member, the antenna, has an electromagnetic radiation reflecting surface on the concave side. The other member, which is the cover, is substantially transparent to electromagnetic radiation. The two members are secured together concave face to concave face. A feedhorn assembly mount is secured through the cover member through an opening provided B therein and the feedhorn assemble can also have an additional cover positioned over its surface. In this way, the entire antenna assembly is fully enclosed and protected from the weather or other outside influences. This arrangement is far more cumbersome and complex in comparison with the applicants' solution to the problem.

The Franklin patent (U.S. Pat. No. 5,451,972) discloses a satellite antenna cover which is primarily intended for a large diameter antenna. This patent discloses a flexible fabric cover for the satellite antenna which serves to conceal the antenna. The cover is fabricated from a synthetic fabric. The disclosed cover has a considerable larger diameter than the subject antenna with a central opening provided for the feedhorn structure. A peripheral hem having a drawstring or elastic threaded therein is provided on the back side. The drawstring is pulled tight by optional tightening devices to secure the cover over the face of the satellite antenna. In FIG. 1 the cover is positioned relatively flat across the face of the antenna with the drawstrings providing the securing arrangements for securing the cover in place. In this arrangement, the feedhorn mounting structure extends outwardly through an aperture provided in the central portion of the cover. The other disclosed cover in this patent extends outwardly forming a central apex which is supported by the mounting structure of the feedhorn. This patent also discloses the provision of decorations or advertising on the cover to improve the appearance of the overall antenna for typical home television usage. This patent does not teach an antenna cover pulled tight across the face of the antenna to prevent the adhesion or accumulation of interfering elements.

SUMMARY OF THE INVENTION

The present invention is primarily directed to a smaller size parabolic satellite antenna which is commonly associated with direct broadcast satellite television. These antennas are usually sized approximately 18 inches to 36 inches in diameter and are considerably more conducive to mounting in inaccessible locations, such as the roof of a dwelling.

Many of these antennas have a lip or flange extending backward from the rim of the parabolic reflective surface in order to strengthen and ridigify the overall structure of the antenna disk.

The present invention provides a tight fitting cover which fits flush across the outer rim of the antenna and provides a flat taut surface. It can be manufactured from marine grade vinyl plastic sheet having UV inhibitors. Although the material can be provided in many colors, color is not considered an attribute or part of the present invention. A formed or extruded "J" clip strip is provided in a length which will extend completely around the perimeter of the cover. The "J" strip can be extruded from polyvinyl chloride or any other suitable polymer material which will provide the strength, rigidity and endurance that is required for long term usage and exposure to weather and the environment.

The strip is folded back on itself along one edge providing a "J" or hooked configuration while the opposite edge is left straight and flat. The width of the strip usually has a dimension which is the same as or slightly less than the width of the lip or flange around the outside rim of the satellite antenna. The reason for this will be explained later.

The marine grade vinyl sheet material which can be used as the cover in this invention has a smooth water resistant outer face surface while the inner surface is usually covered in a nap or soft fleece type material which acts as a protective layer to prevent damage or abrasion to the finished surface of the rim of the antenna. This fleece material also provides a moisture absorbing surface which draws moisture away from the reflective surface of the antenna to minimize the possibility of moisture collecting and interfering with the reflection of the RF signals received by the antenna.

The sheet material used for the cover is cut and sized to fit around the outer edge of the rim of the satellite antenna and includes an additional margin of approximately ½" to 1". The "J" strip is positioned juxtaposed on the outer surface of the cover material with the hook portion of the strip extending inwardly towards the center of the cover with the outer edge of the strip generally even with the outer edge of the cover. The strip is permanently fastened to the cover material along a line which is spaced a predetermined distance from the outer edge. Although any suitable fastening method may be used, in the preferred embodiment, single or double stitch sewing of the strip to the cover material has proven to be quite satisfactory. High strength nylon thread or single filament nylon line can be used for the sewing of the strip to the cover. It is critical that the thread or line used be impervious to the environment so as to maintain the strength of the joint between the cover and the strip.

The attachment line which joins the cover to the strip is spaced inwardly. This is usually within the range of 20 to 33 percent (⅕ to ⅓) of the width of the "J" strip. In this way, the cover, during installation, will be pulled taut across the outer surface of the antenna using the leveraging effect created by the use of the "J" strip.

During installation the "J" strip is folded under towards the back side of the cover material so that the strip will lie adjacent to the outside surface of the flange and the hook will engage the outer edge of the flange. If desired, a short section of the strip, approximately 6 inches in length may be omitted to produce a gap which is positioned at the lower portion of the antenna and near the area where the support for the antenna feedhorn is located. The gap provided in the cover material because of the absence of the strip can be protected with a binding material sewn to the exposed edge. The purpose of the gap is to facilitate the installation of the cover and to provide ventilation to help reduce and stabilize the temperature within the covered antenna.

The positioning and manipulation of the prescribed "J" strip applies a tightening effect to the cover material which pulls and tightens the cover diametrically across the antenna as the strip is installed. Because of the taut condition of the cover, it is impossible for the weather elements or other interfering debris to accumulate on the face of the cover or to come in contact or accumulate on the reflective surface of the antenna which would cause interference with the received signals. Because of the materials used, the present cover is a long term, practical and permanent solution to the problems which have persisted in the past.

It is an object of the present invention to provide a relatively low cost lightweight cover for isolating and protecting the reflective surface of a parabolic satellite antenna. It is a further object of this invention to provide a protective cover for a satellite antenna that can be easily installed so as to provide a tight sealing effect to the antenna without any additional tools. In this way, it is a simple matter for an unskilled person to attach the cover and to provide the unique protection which is desired.

The above and other objects, advantages and features of the present invention will become more readily appreciated and understood when taken together with the following detailed description of the preferred embodiment of the present invention in conjunction with the accompanying drawings.

DETAILED DESCRIPTION OF THE INVENTION

Figure 1:
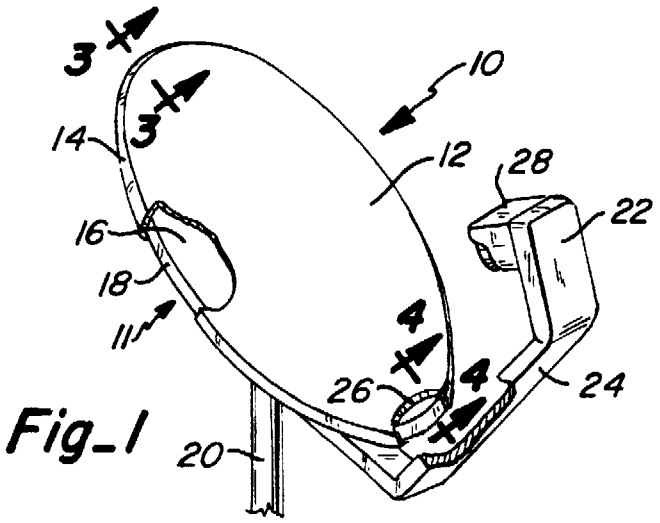
FIG. 1 is a perspective view of a direct broadcast satellite antenna showing the cover of the present invention installed.

Turning now more specifically to FIG. 1, the direct broadcast satellite antenna cover 10, according to the present invention, is shown mounted on a typical satellite antenna 11. The parabolic satellite antenna 11 includes a concave reflective surface 16 for reflecting radio frequency signals and a rolled back flange 18 around the outside circumference of the antenna to provide a strengthening and rigidifying rim 17 to prevent the antenna 11 from twisting and thus, physically distorting the parabolic reflective surface 16. The parabolic reflective surface 16 is precisely contoured to receive, reflect and focus the electromagnetic energy received by the antenna to a precise focal area. The antenna itself has a suitable mounting structure (not shown) attached to the rear surface of the antenna 11 and this structure is supported usually on a pipe or tube 20 having one end securely mounted on a rigid structure or buried in the ground. An additional support arm 24 can be attached to the antenna mounting structure and cantilevered usually from the bottom of the antenna and arranged as a "goose neck" configuration to support a feedhorn 22 positioned at the focal area. The feedhorn 22 usually includes a wave guide and antenna probe 28 which is connected to a low noise amplifier and block down-converter conveniently contained within the feedhorn housing. Coaxial cable extends from the feedhorn 22 to a satellite receiver, usually located within the home or structure. The wave guide and probe 28 are precisely positioned at the focal area of the antenna 11 so as to collect and couple the RF energy that is received and reflected by the antenna 11.

In FIG. 1, the antenna 11 is intended to illustrate a relatively small sized antenna having a diameter of approximately 18–36 inches for receiving the higher powered direct broadcast satellite transmissions. The antenna cover 10 which is described and illustrated in the present application, although not restricted to this size of parabolic antenna, is believed to function quite well and to provide the unique results which are illustrated herein.

The antenna cover 10 includes the cover member 12 and a continuous "J-clip" mounting strip 14 attached to the cover member 12 so that it is semi-permanently mounted and rigidly positioned on the antenna. The "J" strip 14 can have a gap 26 in its attachment to the perimeter of the cover. The gap 26 facilitates the installation of the antenna cover 10 and also provides drainage and ventilation to the concave interior of the antenna.

Figure 2:
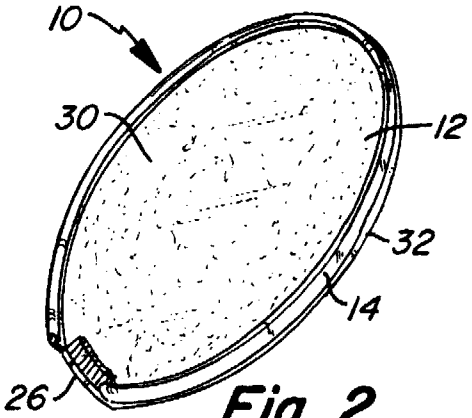
FIG. 2 is a perspective view of the inside surface of the cover shown in FIG. 1 showing the position of the "J" strip used to secure the cover to the antenna.

FIG. 2 shows the inside of the antenna cover 10 from the rear. The cover member 12 can be fabricated from a composite material made up of a polymer, such as a polyvinyl chloride plastic including ultraviolet inhibitors for the outer or face surface layer 30 with an inner layer of cotton, nylon or rayon, flannel or fibrous material which provides a soft cushioning and absorbing surface. The outer face surface is impervious to water and moisture and thus, protects the antenna reflective surface from the elements, such as rain, snow, sleet, hail, etc. The inside surface 32 provides a cushioning effect around the rim 17 of the antenna and prevents abrasion and erosion of the rim and the interior surface of the antenna.

Figure 3:
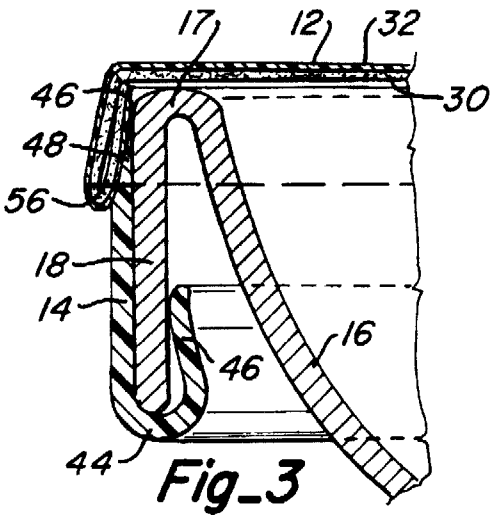
FIG. 3 is a partial cross-sectional view taken along line 3,3 of FIG. 1.
Figure 4:
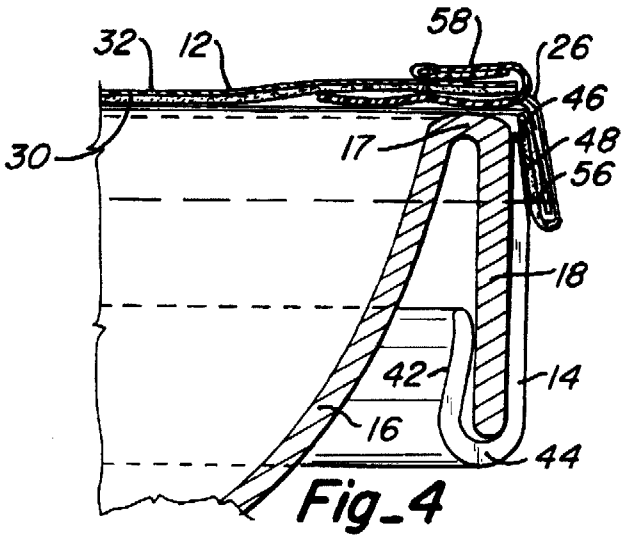
FIG. 4 is a partial sectional view taken along line 4,4 of FIG. 1 and shows a detail through the gap area of the cover.

The key to the present invention is the "J" strip 14 which is used to stretch and retain the cover 12 in its proper position. As seen in FIGS. 3 and 4, the antenna reflective surface 16 follows a precise curvature which provides the reflectivity and focusing of the received RF energy at the feedhorn 22. The outer edge of the parabolic section of the satellite antenna 16 is bent back upon itself usually 90% to the plane of the rim to form a backwardly extending flange 18. The bending and folding of the outer edge or rim of the central portion of the antenna adds considerable rigidity to the antenna structure with the rim 17 laying in one continuous plane. This plane forms the reference for establishing the curvature of the parabolic section of the antenna. The flange 18 can have any desired width with material, weight and cost being considered in determining the actual dimension. It has been found that a flange having a width of approximately one inch is quite satisfactory to provide the rigidity needed for an 18" parabolic satellite antenna.

The "J" strip 14, according to the present invention, has a width dimension "X" which is equal to or slightly less than the width of the flange 18. The "J" strip 14 is formed as a "J-clip" having a shank portion 40 and hook portion 42. The curved transition portion 44 has a radius of curvature of approximately 1½ times the thickness of the flange 18 upon which it is to be used. The hook portion 42 is formed so that it extends backward towards the shank portion 40, leaving an open space which is slightly less than the thickness of the flange 18. In this way, the "J" strip forms a tight fit and seal with the flange 18. The outer edge 46 of the shank portion 40 of the strip 14 has a tapered surface 48 which has a width which is approximately one-fifth of the overall dimension "X".

In order to attach the "J" strip 14 to the cover 12 the flat side of the shank portion 40 is laid against the outer face surface 32 of the cover material with the edge 46 of the strip 14 substantially even with the edge of the cover material. The two parts are permanently fastened together by any suitable arrangement, such as sewing, riveting, heat welding or any other arrangement which will permanently bond and attach the "J" strip 14 to the cover material 12. Sewing has been found to be quite satisfactory for the intended purpose, since it is strong, relatively inexpensive, lightweight and provides a consistent and continuous joint line around the perimeter of the cover. A suitable compatible thread, such as relatively heavy nylon, rayon, waxed cotton or other synthetic fiber can be used for the stitching. It is also possible to use a monofilament nylon line for this purpose. It is important to select a thread or line which can be utilized in the stitching process and still provide long term strength and be unaffected by weather and the elements.

Figure 5:
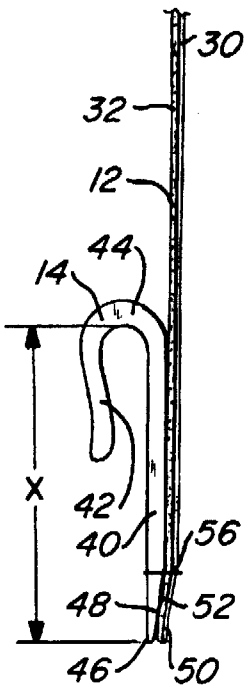
FIG. 5 is a pictorial view of the edge of the cover showing the position of the "J" strip and cover material during the attaching process.

The sewing provides a stitch line or attachment line 56 which is positionally spaced inward from the edge 46 of the "J" strip 14 approximately one-fourth of the total width dimension "X" of the "J" strip. In some cases, this is approximately ¼" where the overall width of the strip 14 is one inch. As can be seen in FIG. 5, the stitch line 56 can be positioned near the start of the tapered surface 48 of the strip. The inwardly spacing of the stitch line 56 creates a narrow loose edge 50 around the circumference of the cover material.

In the gap area 26 the exposed edge of the cover 12 is folded back on itself and stitched with a binding 58 to cover the edge and form a hem.

One of the critical features of the present invention is to provide a water resistant cover which is tightly drawn across the face of the satellite antenna to seal the reflective face of the antenna and provide a smooth, tight surface which prohibits the accumulation of snow, ice, leaves and other debris from collecting on the face of the antenna which can distort the efficient reflectivity of the antenna face.

Another advantage of the present invention is the relatively tight condition of the antenna cover material which adds rigidity to the antenna structure and shields the antenna from the sun's energy to minimize heating and the expansion and contraction of the antenna and the mounting structure so as to prevent physical distortion of the reflective surface. An additional advantage is that the antenna cover stabilizes the antenna in high winds. The flat cover minimizes the wind load effect versus what could be encountered with the parabolic shape of the exposed or uncovered antenna.

The unique construction of the cover, according to this invention, lends itself to the benefits which are stated above. In use, the cover is installed on the antenna by starting one end of the "J" strip 14 at the gap section 26 near the bottom edge of the antenna, usually coinciding with the mounting structure and the support arm for the feedhorn. In this way, properly positioning the cover at the start, the gap is usually centered in relation to the bottom of the antenna. The "J" strip 14 is rolled back from the outside face surface 32 of the antenna cover so that it is folded under the edge of the cover so that the edge 46 of the strip 14 and the material flap 50 is folded back against the inside surface 30 of the cover material 12. In this way, the "J" strip extends outwardly from the edge of the cover and around the perimeter of the cover. The hook portion 42 of the strip 14 is then rolled over the edge of the antenna flange so that the inside surface of the shank portion 40 is adjacent to the outside surface of the flange 18. The edge 46 of the strip pivots around the stitch line 56 with the tapered section 48 and the flap 50 against the inside surface 30 of the cover 12. With the strip installed on the edge of the flange 18 the edge 46 of the strip usually is even with the top of the rim 17 or slightly below. This arrangement pulls the fabric across the surface of the rim 17, pulling it down along the outside edge of the antenna.

As progress is made with the continuous positioning of the hook portion 42 over the edge of the flange 18, the cover becomes more taut. As this occurs, the outer edge 46 of the strip 14 directly contacts the outer surface of the flange 18 producing a leveraging effect during the installation with the edge 46 becoming the fulcrum and the width of the strip 14 represented by the dimension "X" forming a lever arm for applying force to the cover so as to stretch the cover as the edge is installed. As the installation progresses around the perimeter of the antenna, maximum leverage is provided at a point diametrically opposite the original starting point for the strip. This leverage continues as the strip is installed until the opposite end of the strip is secured to the flange 18. In this way, the cover material is securely attached and is tensioned across the face of the antenna providing the desired taut condition. At the same time, the gap area 26 is located at the lower most point on the antenna to allow any moisture which may get into or under the cover to drain away through gravity. The gap can also be large enough to allow breathing under the cover to lower the temperature and dissipate any residual moisture.

Throughout this application, reference has been made to the use of a marine grade vinyl plastic sheet having a flannel backing for the cover material. It is to be understood, however, that any moisture impervious material may be used for this purpose, so long as the material will stretch to provide the desired taut condition and retain this condition over a period of time. While vinyl has been suggested, any other suitable plastic or synthetic or natural material which has these characteristics can be used. In the same way, the "J" strip can be fabricated from any plastic, such as polyvinyl chloride, polyethylene, polypropylene or synthetic resin possibly reinforced with fiberglass or other suitable fibers, if desired. It is important that this material be flexible enough to allow the positioning of the hook portion of the strip over the edge of the flange while the shank portion must be rigid enough to provide the leveraging effect which is required.

While an improved broadcast satellite antenna cover has been shown and described in detail in this application, it is to be understood that this invention is not to be limited to the exact form disclosed and changes in detail and construction of the various embodiments of this invention may be made without departing from the spirit thereof.

What is claimed is:

1. A protective cover for a direct broadcast satellite antenna having a parabolic reflective surface, said antenna having a backward flange extending at least partially around the perimeter of the antenna, said cover comprising:

a. a cover member fabricated from a flexible, liquid impervious sheet material, said cover member having an outer configuration which is the same as the outer dimension of the antenna with an additional margin around the entire outside perimeter of approximately one half of the width of the antenna flange;

b. an elongated "J" strip having a hook shaped lip along one edge, a straight edge along the opposite edge and a shank portion in between, the width of the strip being the same or slightly less than the width of the antenna flange;

c. attaching means for attaching the "J" strip to said cover member, the straight edge of said "J" strip being generally aligned with the outer edge of said cover member and the shank portion juxtaposed with said cover, said "J" strip being arranged to extend at least partially around the circumference of said cover edge whereby the cover member can be mounted on the antenna in a taut configuration by engaging the hooked lip of the "J" strip over the flange so as to protect the reflective surface of the antenna and to prevent accumulation of ice, snow, leaves and other deleterious objects on the antenna.

2. A protective cover as defined in claim 1 wherein said cover member has an outer face surface.

3. A protective cover as defined in claim 2 wherein said shank portion of the "J" strip has a flat side opposite the side having the hook shaped lip, and said flat side of said shank portion is positioned adjacent to the face surface of said cover member prior to being attached.

4. A protective cover as defined in claim 3 wherein said attaching means is spaced inward from the aligned straight edge of said "J" strip and cover member approximately one-fifth to one-third of the width of said "J" strip.

5. A protective cover as defined in claim 4 wherein said attaching means is a stitch line holding the "J" strip and cover member in position.

6. A protective cover as defined in claim 5 wherein the stitch line is made from a strong material which will maintain its strength over a period of time.

7. A protective cover as defined in claim 6 wherein the material is a nylon thread.

8. A protective cover as defined in claim 1 wherein the shank portion near the straight edge of said "J" strip is tapered starting from a point approximately one-fifth to one-third of the width of said strip to the outer straight edge of said strip, and the attaching means is positioned adjacent to the start of the area of the tapered portion of the said strip.

9. A protective cover as defined in claim 1 wherein the elongated "J" strip extends around the circumference of the antenna.

10. A protective cover as defined in claim 9 wherein the "J" strip attached to said cover is omitted along a gap of six inches or less and is formed in the outer perimeter of the cover to allow drainage and ventilation to the reflective surface of said antenna.

11. A protective cover as defined in claim 1 wherein the cover member is formed from a marine vinyl plastic material.

12. A protective cover for a direct broadcast satellite antenna having a parabolic reflective surface, said antenna having a backward flange extending at least partially around the perimeter of the antenna, said cover comprising:

a. a cover member fabricated from a flexible, water impervious sheet material, having an outer face surface and a perimeter configuration which is the same as the outer dimensions of the antenna with an additional margin of one-half of the width of the antenna flange extending around the entire outside perimeter of said cover member;

b. a "J" strip having a hook shaped lip along one edge, a shank portion having a flat surface opposite said hook shaped lip and a straight edge along the opposite edge of said strip, the width of the strip being approximately the same or slightly less than the width of the antenna flange; and c. attaching means for attaching said cover member to said "J" strip with said "J" strip extending substantially around the circumference of said cover member with the flat shank portion of said strip being positioned in contact with the face surface of said cover member and the straight edge aligned with the perimeter edge of said cover member, said strip and cover member being attached by at least one stitch line spaced approximately one-third to one-fifth of the width of said "J" strip from the straight edge of said strip so that the cover member can be mounted on the antenna in a taut condition by engaging the hooked end of the strip over the edge of the flange so as to protect the reflective surface and prevent the accumulation of ice, snow, leaves and other deleterious objects on the antenna.

13. A protective cover as defined in claim 12 wherein the shank portion of the "J" strip is tapered from a point approximately one-fifth to one-third of the width of said strip to a relatively thin edge along the straight edge of said strip.

14. A protective cover as defined in claim 12 wherein the opposite side of said cover member from said face surface contains a nap type material to prevent abrasion where the cover contacts the outer edge of the antenna.

15. A protective cover as defined in claim 12 wherein said "J" strip is formed from a relatively rigid plastic material which will allow the hook edge of the strip to grip the edge of the flange and thus, hold the cover member tightly across the parabolic reflective surface of said antenna.

16. A protective cover as defined in claim 15 wherein the "J" strip is extruded as a continuous one piece strip for attachment to the cover member.

17. A method for mounting a cover in a taut configuration over the rim of a parabolic direct broadcast satellite antenna having a backward flange extending around the perimeter of said antenna, the steps of said method including:

a. forming an antenna cover member having an outer face surface by sizing a sheet of flexible, water impervious material so as to have an outside dimension equal to the outside dimension of the satellite antenna with the addition of a margin of approximately one-half of the width said antenna flange;

b. forming an elongated "J" strip wherein the strip includes a hook shaped lip along one edge and a straight edge along the opposite edge with a shank portion in between, said shank portion having a flat surface on one side of the strip opposite the hook shaped lip;

c. positioning the flat surface of the shank portion of the "J" strip against the face surface of the cover and aligning the straight edge of said strip with the edge of said cover and arranging the strip so that it extends substantially around the perimeter of said cover;

d. attaching the "J" strip to the cover along an attachment line which is spaced inwardly approximately one-fifth to one-third of the width of the "J" strip from the edge of the cover and "J" strip;

e. positioning the cower over the rim of the satellite antenna and rolling the "J" strip outward and under the face surface of the cover and attaching the hook lip of the strip over the edge of the antenna flange; and f. progressively working the "J" strip continuously around the flange of the satellite antenna until the entire length of the "J" strip is engaged with said flange so as to produce a stretching effect in the cover to pull it tightly across the rim of the antenna to produce a taut condition in said cover when mounted to the antenna to prevent the collection and accumulation of ice, snow, leaves and other deleterious objects on said direct broadcast satellite antenna.

18. A method of covering a satellite antenna as described in claim 17 which includes the additional step of engaging the straight edge of the "J" strip against the flange and pivoting the hooked edge of the strip down into contact with the edge of the flange so as to cause a leveraging effect on the cover material so as to stretch the material to produce a taut condition in the satellite cover.

19. A method of covering a satellite antenna as described in claim 17 wherein the "J" strip is extruded to produce an elongated continuous strip having a length which is at least the circumference of the outer edge of the satellite antenna cover.

20. A method of covering a satellite antenna as described in claim 17 which further includes the step of sewing the "J" strip to the cover forming the attachment line spaced inwardly from the edge of the strip.

* * * * *